US010799426B2

(12) United States Patent
Sheu

(10) Patent No.: US 10,799,426 B2
(45) Date of Patent: Oct. 13, 2020

(54) NIPPLE STRUCTURE

(71) Applicant: Miin-Tsang Sheu, Changhua (TW)

(72) Inventor: Miin-Tsang Sheu, Changhua (TW)

( * ) Notice: Subject to any disclaimer, the term of this patent is extended or adjusted under 35 U.S.C. 154(b) by 12 days.

(21) Appl. No.: 15/997,778

(22) Filed: Jun. 5, 2018

(65) Prior Publication Data

US 2019/0029925 A1 Jan. 31, 2019

(30) Foreign Application Priority Data

Jul. 27, 2017 (TW) ..... 106125660 A

(51) Int. Cl.
*A61J 11/00* (2006.01)
*A61J 11/02* (2006.01)
*A61J 11/04* (2006.01)

(52) U.S. Cl.
CPC ..... *A61J 11/0025* (2013.01); *A61J 11/008* (2013.01); *A61J 11/02* (2013.01); *A61J 11/045* (2013.01); *A61J 11/0015* (2013.01)

(58) Field of Classification Search
CPC ..... A61J 11/0025; A61J 11/02; A47J 43/04; A47J 43/72
USPC ..... 215/11.1–11.5, 308, DIG. 8; 220/711, 220/714
See application file for complete search history.

(56) References Cited

U.S. PATENT DOCUMENTS 1,041,378 A * 10/1912 Tweeddale ..... A47J 36/08 210/469
1,672,466 A * 6/1928 Oshman ..... A61J 9/00 215/11.1
1,672,467 A * 6/1928 Oshman ..... A61J 9/00 215/11.1
2,525,745 A * 10/1950 Wycoff ..... A61J 9/008 215/11.5
6,045,254 A * 4/2000 Inbar ..... A61J 9/00 366/130

* cited by examiner

*Primary Examiner* — Fenn C Mathew
*Assistant Examiner* — Jennifer Castriotta
(74) *Attorney, Agent, or Firm* — Karin L. Williams; Mayer & Williams PC

(57) ABSTRACT

A pacifier structure is mounted on a nursing bottle containing a rotatable cap, a body, and a filtration member. The rotatable cap includes a peripheral groove, the body includes a suction portion and a surround plane, the surround plane has an air valve, the surround plane connects with the peripheral groove to produce an air chamber, and a trench is defined between the body and the peripheral groove. The filtration member includes a ring portion, at least one connection tab, and a mesh portion. The ring portion has an arcuate recess, a diameter defined by the at least two connection tabs is more than an inner diameter of the body, the mesh portion has a large section adjacent to the ring portion and a small section away from the ring portion. The large section has a greater diameter than the small section, and the mesh portion has multiple orifices.

2 Claims, 6 Drawing Sheets

NIPPLE STRUCTURE

FIELD OF THE INVENTION

The present invention relates to a pacifier structure which reduces air inflation in user's abdomen.

BACKGROUND OF THE INVENTION

With reference to FIG. 6, a conventional pacifier structure contains a body 20 including a surround plane 22 and a trench 23 defined between the body and the surround plane 22. A rotatable cap 10 includes an opening 13 connected with the trench 23 of the body 20 so that the rotatable cap 10 covers a nursing bottle 40 to avoid liquid leakage from the nursing bottle 40.

The body 20 includes a suction portion 21 partially accommodated in the nursing bottle 40 and extending upward from the surround plane 22, and the body 20 includes the surround plane 22 being hollow and includes a liquid chamber 24 defined between the suction portion 21 and the surround plane 22. The surround plane 22 has an air cavity 12 defined on a top and has an inlet valve 221 arranged on a bottom of the surround pane 22, and the air valve 221 has orifices so that when the mouth 401 of the nursing bottle 40 is used, gas in the nursing bottle 40 flows through the orifices of the air valve 221, and the gas exchanges in the air cavity 12.

However, the conventional pacifier structure has defects as follows:

When the body 20 is sucked to produce bubbles B in the liquid W, the bubbles B gathering in the liquid chamber 24 are sucked into user's abdomen to cause air inflation.

The bubbles cannot be broken, because a filtration member of the conventional pacifier structure is a plane or has an arcuate bottom, the liquid forms a water film on the orifices to stop the liquid flowing through the orifices, and an air chamber forms on a front end of the body to gather the gas, thus sucking the gas into the user's abdomen.

The present invention has arisen to mitigate and/or obviate the afore-described disadvantages.

SUMMARY OF THE INVENTION

The primary aspect of the present invention is to provide a pacifier structure which reduces air inflation in user's abdomen.

To obtain the above aspect, a pacifier structure provided by the present invention is mounted on a nursing bottle which contains: a rotatable cap, a body, and a filtration member.

The rotatable cap is mounted on a mouth of the nursing bottle, and the rotatable cap includes a peripheral groove formed around an inner wall thereof. The body includes a suction portion and a surround plane arranged around a bottom of the body and connecting with the peripheral groove of the rotatable cap, the suction portion is hollow, the surround plane has an air valve extending to the nursing bottle from the surround plane, the surround plane connects with the peripheral groove so as to produce an air chamber, and a trench is defined between the body and the peripheral groove.

The filtration member is connected inside the body and includes a ring portion, at least one connection tab and a mesh portion, wherein the ring portion contacts with the surround plane of the body and has an arcuate recess configured to accommodate the air valve, the at least two connection tabs extending upward from an inner side of the ring portion and connects with an inner wall of the body, wherein a diameter defined by the at least two connection tabs is greater than an inner diameter of the body, the mesh portion is hollowly conical and has a large section adjacent to the ring portion and a small section away from the ring portion, wherein the large section of the mesh portion is more than the small section of the mesh portion, and the mesh portion has multiple orifices formed on the small section thereof.

Thereby, when the nursing bottle is held upside down by a user, the filtration member is located above the body so that the at least one connection tab retains with the inner wall of the body, the liquid flows through the mesh portion of the filtration member, and the bubbles produced by sucking the liquid in the body are stopped by the filtration member. In the meantime, the bubbles attached on the multiple orifices of the mesh portion are broken by the water pressure of the large section of the mesh portion, and the mesh portion separates the undissolved particles and milk powders in the nursing bottle.

FIG. **4*a*** is a cross-sectional perspective view showing the assembly of a part of the pacifier structure according to the preferred embodiment of the present invention.

Figure 5:
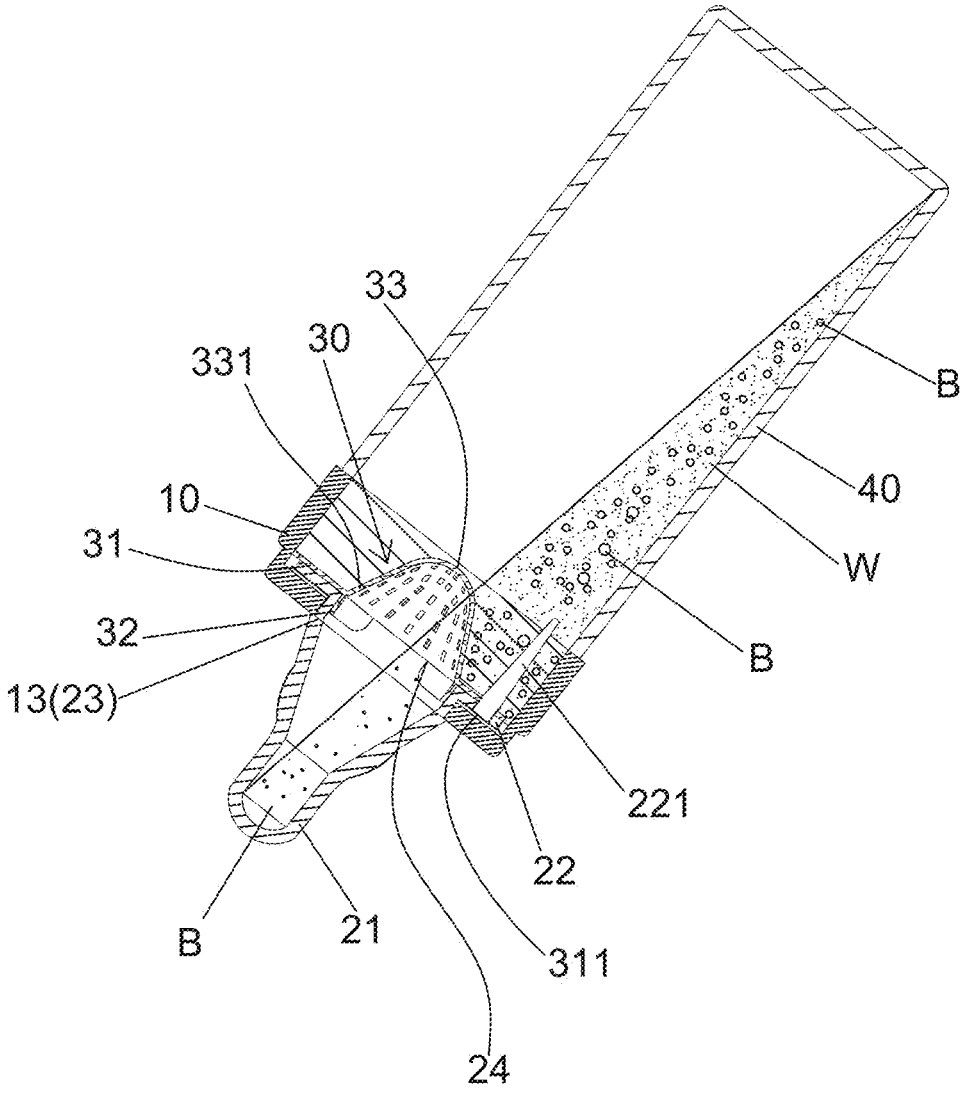

FIG. 5 is a cross sectional view showing the operation of the pacifier structure according to the preferred embodiment of the present invention.

Figure 6:
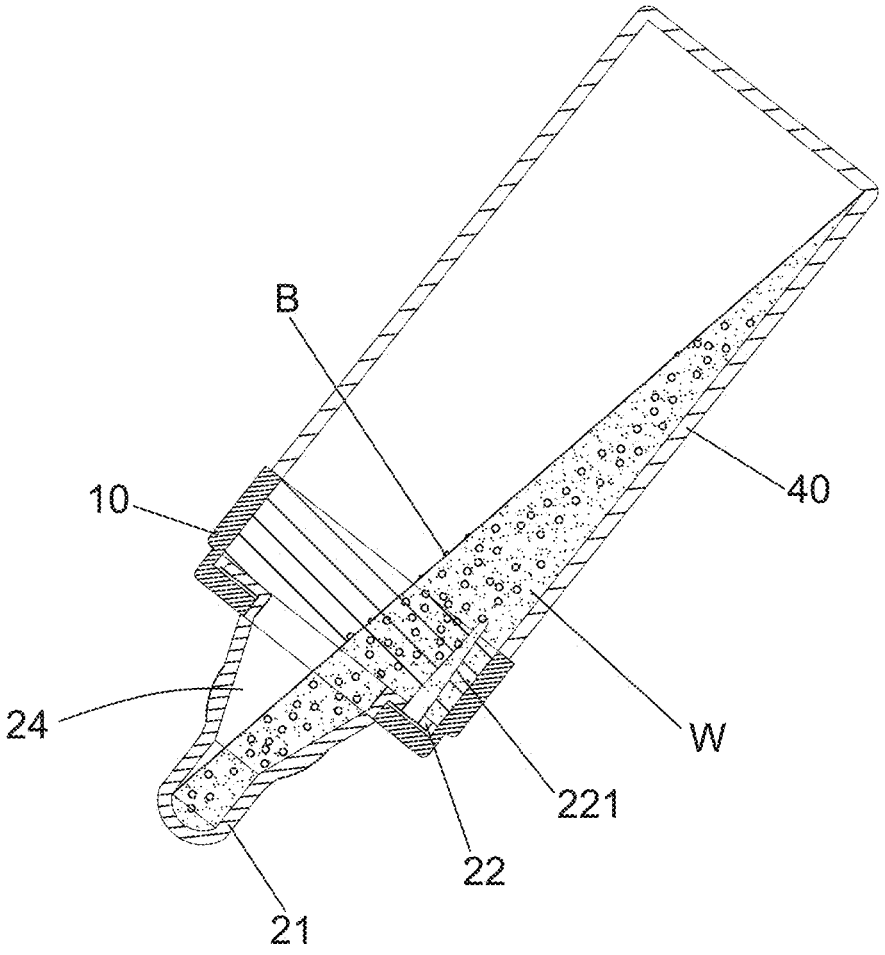
PRIOR ART FIG.6

FIG. 6 is a cross sectional view showing the operation of a conventional pacifier structure.

DETAILED DESCRIPTION OF THE PREFERRED EMBODIMENTS

With reference to FIGS. 2-6, a pacifier structure according to a preferred embodiment of the present invention is mounted on a nursing bottle comprised of a rotatable cap 10, a body 20, and a filtration member 30.

Referring to FIGS. 1-5, the rotatable cap 10 is mounted on a mouth 401 of the nursing bottle 40, and the rotatable cap 10 includes a peripheral groove 11 formed around an inner wall thereof.

As shown in FIGS. 1-5, the body 20 includes a suction portion 21 and a surround plane 22 arranged around a bottom of the body 20 and connecting with the peripheral groove 11 of the rotatable cap 10, the rotatable cap 10 includes an opening 13, wherein the suction portion 21 is hollow, the surround plane 22 has an air valve 221 extending to the nursing bottle 40 from the surround plane 22, the surround plane 22 connects with the peripheral groove 11 so as to produce an air chamber 12, and a trench 23 is defined between the body 20 and the peripheral groove 11.

As illustrated in FIGS. 1-5 and 4*a*, the filtration member 30 is connected inside the body 20 and includes a ring portion 31, at least one connection tab 32 and a mesh portion 33, wherein the ring portion 31 contacts with the surround plane 22 of the body 20 and has an arcuate recess 311 configured to accommodate the air valve 221, the at least one connection tab 32 extends upward from an inner side of the ring portion 31 and connects with an inner wall of the body 20, wherein a diameter defined by the at least one connection tab 32 is more than an inner diameter of the body 20, the mesh portion 33 is hollowly conical and has a large section adjacent to the ring portion 31 and a small section away from the ring portion 31, wherein the large section of the mesh portion 33 has a greater diameter than the small section of the mesh portion 33, and the mesh portion 33 has multiple orifices 331 formed on the small section thereof, such that when the mesh portion 33 of the filtration member 30 soaks with liquid in the nursing bottle 40 and the nursing bottle 40 is sucked upside down, a water pressure of the small section of the mesh portion 33 is more than that of the large section of the mesh portion 33, bubbles B on the mesh portion 33 are pushed by the water and the liquid W flows into a cavity 24 of the body 20 from the large section of the mesh portion 33, then gas in the cavity 24 floats into the nursing bottle 40 via the small section of the mesh portion 33, and the mesh portion 33 filters undissolved particles in the nursing bottle 40. Preferably, the at least one connection tab 32 retains with the inner wall of the body 20 matingly so that the filtration member 30 supports the body 20.

Figure 1:
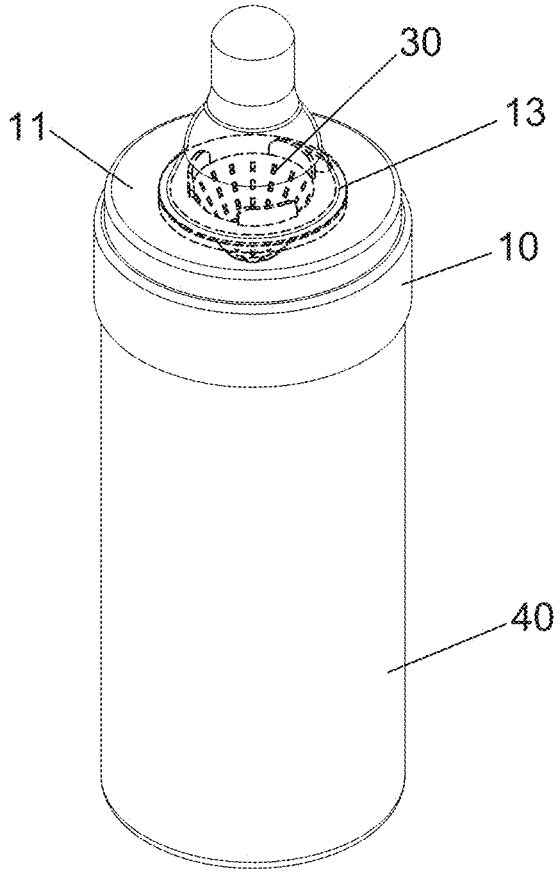
FIG. 1 is a perspective view showing the assembly of a pacifier structure according to a preferred embodiment of the present invention.
Figure 2:
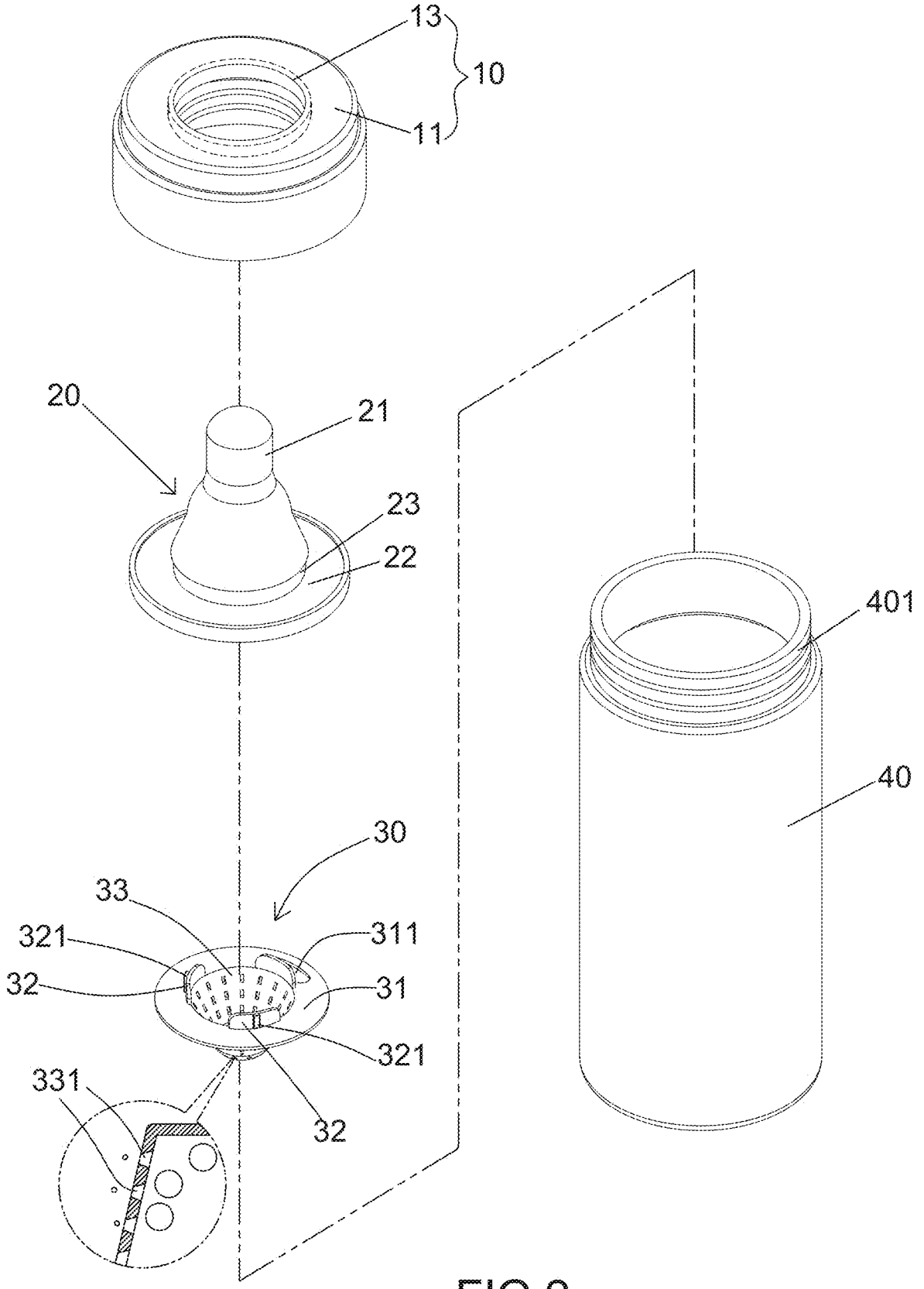
FIG. 2 is a perspective view showing the exploded components of the pacifier structure according to the preferred embodiment of the present invention.
Figure 3:
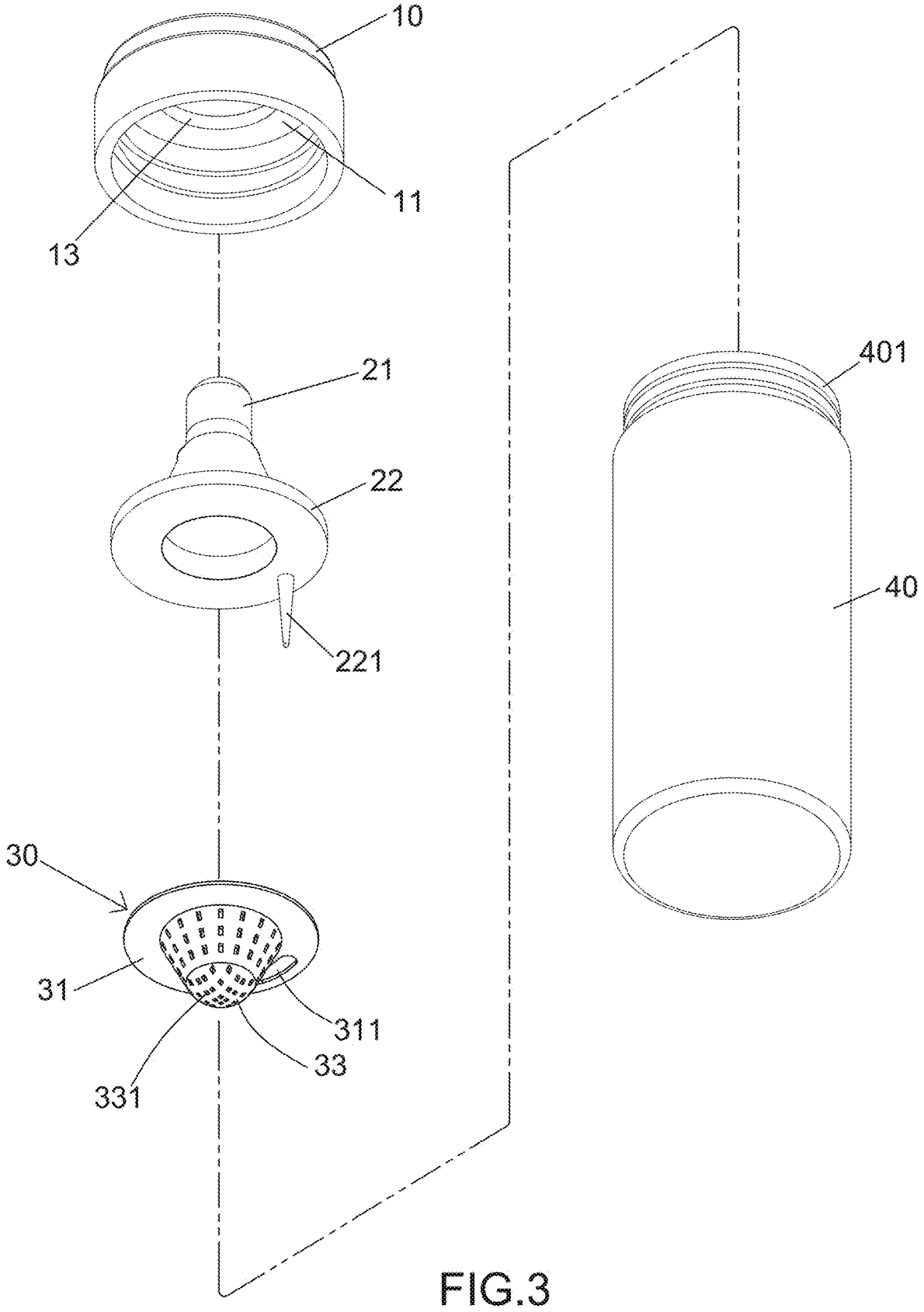
FIG. 3 is another perspective view showing the exploded components of the pacifier structure according to the preferred embodiment of the present invention.
Figure 4A:
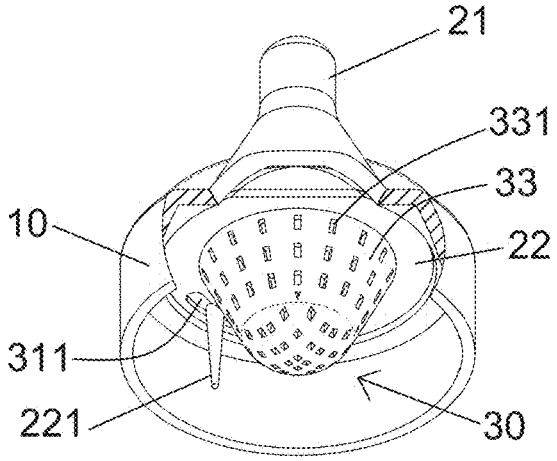
FIG. 4 is a cross sectional view showing the assembly of the pacifier structure according to the preferred embodiment of the present invention.
Figure 4:
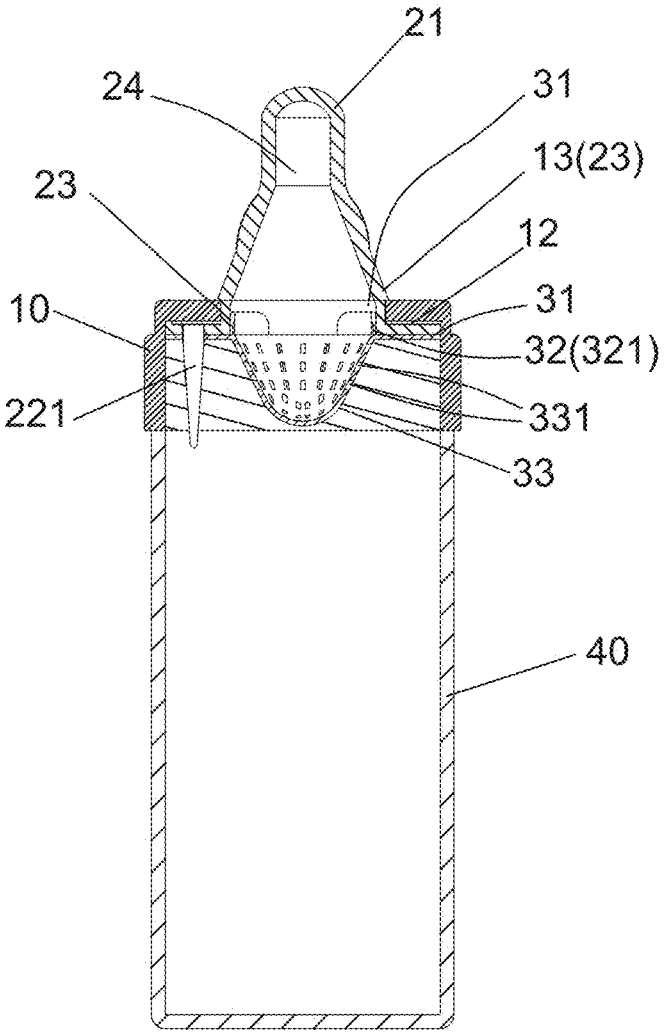

With reference to FIGS. 2 and 4, each of the at least one connection tab 32 has a locking rib 321 formed thereon so as to retain with the inner wall of the body 20.

Referring to FIGS. 1-5, in operation, the filtration member 30 is forced in the body 20 so that the at least one connection tab 32 retains with the inner wall of the body 20, and the ring portion 31 contacts with the surround plane 22 of the body 20. When the body 20 is locked into the mouth 401 of the nursing bottle 40, the ring portion 31 is forced by the mouth 401, and the air valve 221 of the body 20 is inserted into the arcuate recess 311 of the ring portion 31 of the filtration member 30 so as to communicate with the nursing bottle 40.

As shown in FIGS. 1-5, when the nursing bottle 40 is held upside down by a user, the filtration member 30 is located above the body 20 so that the at least one connection tab 32 retains with the inner wall of the body 20, the liquid W flows through the mesh portion 33 of the filtration member 30, and the bubbles B produced by sucking the liquid W in the body 20 are stopped by the filtration member 30. In the meantime, the bubbles B attached on the multiple orifices 331 of the mesh portion 33 are broken by the water pressure of the large section of the mesh portion 33, and the mesh portion 33 separates the undissolved particles and milk powders in the nursing bottle 40.

As illustrated in FIGS. 1-5, the suction portion 21 provides the gas outside and inside the nursing bottle 40 via the air valve 221 of the body 20 as sucking the suction portion 21, the gas flows into the liquid through the air chamber 12 so as to produce the bubbles in the liquid, and the bubbles B are stopped or broken by the mesh portion 31 of the filtration member 30, thus reducing air inflation in user's abdomen.

The filtration member 30 matches with common pacifiers so as to reduce air inflation in user's abdomen.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention

What is claimed is:

1. A pacifier structure being mounted on a nursing bottle comprising: a rotatable cap, a body, and a filtration member;

the rotatable cap being mounted on a mouth of the nursing bottle, and the rotatable cap including a peripheral groove formed around an inner wall thereof; the body including a suction portion and a surround plane arranged around a bottom of the body and connecting with the peripheral groove of the rotatable cap, the suction portion being hollow, the surround plane having an air valve extending toward the nursing bottle from the surround plane, the surround plane connecting with the peripheral groove so as to produce an air chamber, and a trench being defined between the body and the peripheral groove;

wherein the filtration member is connected inside the body and includes a ring portion, at least two connection tabs and a mesh portion, wherein the ring portion contacts with the surround plane of the body and has an arcuate recess configured to accommodate the air valve, the at least two connection tabs extending upward from an inner side of the ring portion and connecting with an inner wall of the body, wherein a diameter defined by the at least two connection tabs is more than an inner diameter of the body, the mesh portion is hollowly conical and has a large section adjacent to the ring portion and a small section away from the ring portion, wherein the diameter of the large section of the mesh portion is greater than the diameter of the small section of the mesh portion, and the mesh portion has multiple orifices formed on the small section thereof.

2. The pacifier structure as claimed in claim 1, wherein each of the at least two connection tabs has a locking rib formed thereon so as to retain with the inner wall of the body.

* * * * *